US006553598B1

(12) United States Patent
Sansotta

(10) Patent No.: US 6,553,598 B1
(45) Date of Patent: Apr. 29, 2003

(54) GOLF BALL CLEANER

(76) Inventor: Gary R Sansotta, 2118 E. Carson St., Pittsburgh, PA (US) 15203

( * ) Notice: Subject to any disclaimer, the term of this patent is extended or adjusted under 35 U.S.C. 154(b) by 0 days.

(21) Appl. No.: 10/072,449

(22) Filed: Feb. 6, 2002

(51) Int. Cl.[7] ..... A63B 47/04
(52) U.S. Cl. ..... 15/21.2; 15/21.1
(58) Field of Search ..... 15/21.2, 21.1

(56) References Cited

U.S. PATENT DOCUMENTS

| | | | | |
|---|---|---|---|---|
| 1,602,016 | A | | 10/1926 | Hamilton |
| 1,730,973 | A | | 10/1929 | Henrizi |
| 1,792,211 | A | | 2/1931 | Brewer |
| 1,862,437 | A | | 6/1932 | Signorini |
| 2,198,441 | A | | 4/1940 | Mollart |
| 3,041,645 | A | * | 7/1962 | Smith |
| 3,077,626 | A | | 2/1963 | Thomson |
| 3,981,039 | A | | 9/1976 | Rumph |
| 4,163,299 | A | | 8/1979 | Duda |
| 4,344,203 | A | | 8/1982 | Gerrick |
| 4,955,261 | A | | 9/1990 | Chiang |
| 5,400,455 | A | | 3/1995 | Crossley |
| 5,758,379 | A | | 6/1998 | Hovnanian |

* cited by examiner

*Primary Examiner*—Randall E. Chin
(74) *Attorney, Agent, or Firm*—Michael I Kroll

(57) ABSTRACT

The present invention 10 discloses a hand-operated golf ball 18 cleaning device comprising a housing 22 having bristles 34 located therein, wherein the bristle ends being configured to form a circular, semi-spherical entrainment groove 35 into which the golf balls 18 to be cleaned are placed for cleaning. Also shown are a hinged 26, securable cover 24 with a central recess for accommodating a shaft member 36, a shaft member 36 having a handle 14 portion on the exterior distal end, a ball entrainment block 30 on the distal end facing the housing, and a means therebetween for rotatably securing the shaft member within the shaft recess of the cover. The entrainment block 30 has two recesses 32 of a diameter similar to that of a golf ball 18 and sized to receive approximately one-third of each ball therein when the cover 24 is closed. The turning of the handle 14 rotates the shaft 36 and the entrainment block 30 with the golf balls 18 rotatably secured therein meanwhile applying sufficient pressure to the balls so they remain frictionally engaged with the bristle ends 34 as the bristle ends dislodge dirt and debris from the dimples and rotate the balls inside the recesses 32 of the spinning entrainment block 30 as they travel along the entrainment groove 35 formed by the bristle ends.

14 Claims, 6 Drawing Sheets

GOLF BALL CLEANER

BACKGROUND OF THE INVENTION

1. Field of the Invention

The present invention relates generally to golf ball cleaners, and more specifically, to a hand operated golf ball cleaning device comprising: a housing having bristles located therein, the bristle ends being configured to form a circular, semi-spherical entrainment groove into which the golf balls to be cleaned are placed for cleaning; a hinged, securable cover with a central recess for accommodating a shaft member; a shaft member having a handle portion on the exterior distal end, a ball entrainment block on the distal end facing said housing, and a means therebetween for rotatably securing the shaft member within the shaft recess of the cover. The entrainment block has two recesses of a diameter similar to that of a golf ball and sized to receive approximately one third of each ball therein when the cover is closed. The turning of the handle rotates the shaft and the entrainment block with the golf balls rotatably secured therein meanwhile applying sufficient pressure to the balls so they remain frictionally engaged with the bristle ends as the bristle ends dislodge dirt and debris from the dimples and rotate the balls inside the recesses of the spinning entrainment block as they travel along the entrainment groove formed by the bristle ends.

Golf balls have improved aerodynamic properties due to their dimpled surface. The dimples often accumulate dirt, mud and other such debris once the ball is in play due the nature of a golf course and thereby hinder the golfer by not allowing the ball to fly right. Many golf courses don't have golf ball cleaning devices and the ones that do have them may not have enough or don't have them located where they are needed. The present invention seeks to overcome the shortcomings of the prior art by providing a portable, hand-operated golf ball cleaning device that is fast, thorough and easy to use and has means for clipping onto a golf bag so as to always be readily available when needed.

2. Description of the Prior Art

There are other cleaning devices designed for removing dirt and debris from golf balls and other such small spherical objects. Typical of these is U.S. Pat. No. 1,602,016 issued to James E. Harrington on Oct. 5, 1926.

Another patent was issued to Charles F. Henrizi on Oct. 8, 1929 as U.S. Pat. No. 1,730,973. Yet another U.S. Pat. No. 1,792,211 was issued to Edward Brewer on Feb. 10, 1931 and still yet another was issued to Luigi Signorini on Jun. 7, 1932 as U.S. Pat. No. 1,862,437.

Another patent was issued to Lobegott Mollart on Apr. 23, 1940 as U.S. Pat. No. 2,198,441. Yet another U.S. Pat. No. 3,077,626 was issued to D. P. McDonald Thomson on Feb. 19, 1963. Another was issued to Louis B. Smith on July 3, 1962 as U.S. Pat. No. 3,041,645 and still yet another was issued on Sep. 21, 1976 to Joel D. Rumph as U.S. Pat. No. 3,981,039. A patent was issued on Aug. 7, 1979 to Alex J. Duda as U.S. Pat. No. 4,163,299 and on Aug. 17, 1982 U.S. Pat. No. 4,344,203 was issued to Richard L. Gerrick.

Another patent was issued to Norman Crossley on Mar. 28, 1995 as U.S. Pat. No. 5,400,455 and on Jun. 2, 1998 U.S. Pat. No. 5,758,379 was issued to Vahank Stephan Hovnanian.

U.S. Pat. No. 1,602,016

Inventor: James E. Hamilton

Issued: Oct. 5, 1926

A ball cleaner including a ball carrier; a brush carrier abreast of the ball carrier and defining therewith a ball zone; a brush upon the brush carrier projecting into the ball zone; a container enclosing one of said brush carriers and the brush, the other carrier constituting a lid for the container; a rotatable shaft supporting said enclosed carrier; and a sleeve bearing for this shaft and supported by the carrier that constitutes a lid.

U.S. Pat. No. 1,730,973

Inventor: Charles F. Henrizi

Issued: Oct. 8, 1929

A golf ball cleaner comprising a two part casing, including a lower water compartment and an upper cover portion, laterally projecting bearings at the central portion of said casing, a rotatable shaft mounted in the bearings and extending transversely of the casing, a disc fixed on the shaft rotatable within the casing, said disc having a plurality of apertures therethrough arranged circumferentially thereof, laterally projecting flanges surrounding said apertures for receiving therein golf balls, a crank attached to one end of the shaft for rotating the disc, opposed brush members arranged in the water compartment and between which the disc passes, the upper portion of said casing having an opening in one side thereof, a movable flap normally closing the opening for receiving therethrough an object to engage the golf balls to remove them from the disc through the opening.

U.S. Pat. No. 4,955,261

Inventor: Edward Godfrey Brewer

Issued: Feb. 10, 1931

A machine for cleaning golf and like balls comprising in combination, a cylindrical casing, a base to such cylindrical casing containing a circular groove eccentrically arranged relatively to the axis of said cylindrical casing, a brush rotatably mounted and adapted to contact with the upper surface of balls contained in the circular groove, a cage having radial openings for separating the balls, being suitably mounted between the base and the brush, a brake engaging the cage, and means for rotating said brush.

U.S. Pat. No. 1,862,437

Inventor: Luigi Signorini

Issued: Jun. 7, 1932

A golf ball cleaning device, comprising a water container, a pair of vertically disposed circular brushes, one of which is moving relatively to the other, the bristles sides of said brushes being arranged in opposed relation and spaced from each other less than the diameter of a golf ball so as to receive therebetween a golf ball to be cleaned, means for actuating said movable brush thereby causing said golf ball to be acted upon by said brushes during it's travel about the axes thereof, and a guard for encircling the lower parts of said brushes to prevent accidental disengagement of the golf ball therefrom, said guard being open on top.

U.S. Pat. No. 2,198,441

Inventor: Lobegott Mollart

Issued: Apr. 23, 1940

In a device of the character described: a liquid receptacle open at its top and comprising side, end, and bottom walls;

a rotatable brush in the receptacle; a shaft for the brush journalled in one side wall of the receptacle, the ends of the bristles of the brush being spaced from one side wall of the receptacle; a member in the receptacle between the ends of the bristles of the brush and the side wall of the receptacle from which the same are spaced, said member having a part forming a cover for the open top of the receptacle and being bodily removable therethrough; means on said member defining a tortuous passageway which is open throughout its length at its side facing the brush so that a ball deposited in the passageway will be subjected to a scrubbing action by the brush and advanced thereby through the tortuous passageway as the brush is rotated; and means yieldingly urging said member laterally toward the brush to insure the continuance of the proper contact of the brush bristles with a ball in the passageway as the bristles become worn.

U.S. Pat. No. 3,077,626

Inventor: David Peter McDonald Thompson

Issued: Feb. 19, 1963

In a device for use in cleaning golf balls comprising a drum-shaped casing having an opening through which a golf ball may be inserted, a carrier member within the casing having a recess for the golf ball when so inserted, and rotatable for the entrainment of the ball within the casing, opposed front and rear walls forming part of said casing, sponge linings fixed to said walls for frictionally engaging the ball and cleaning same when the ball is so entrained; said carrier member being located nearer the lining on one wall than the lining on the other wall, whereby rotation of the ball about its own centre is promoted, and an annular peripheral portion on the lining further from the carrier stepped nearer the carrier member than the remainder of said lining, whereby rotation of said ball around its center is still promoted.

U.S. Pat. No. 3,041,645

Inventor: Louis B. Smith

Issued: Jul. 3, 1962

In a portable golf ball washer, a cup-shaped cylindrical casing, a cup shaped cylindrical sponge lining the inner wall of said casing, a centrally located post extending from the bottom of said casing outwardly of the open end of said casing and terminating at a point outside thereof, means connecting said post to the bottom of said casing and securing the post and casing against relative translatory movement, a cup-shaped circular cover having a position closing the open end of said casing and an opening receiving said post and rotatably connected to said post near the outer end thereof, said cover being supported on said post for movement away from said position closing the casing to provide access to said casing, a washer-shaped friction disc concentrically secured to the underside of said cover and disposed about said post, and cover rotating means for rotating ball therein for cleaning the same, said cover rotating means comprising a lever having one end pivotably connected to the upper side of said cover near the periphery thereof for movement in a plane parallel to the plane said cover into and out of engagement with said post and having a part in the center thereof including a notch adapted to engage a groove in said post disposed in the plane of said lever so as to prevent the axial displacement of said cover on said post, and a knob on the other end of said lever for moving said lever into and out of engagement with said post and rotating said cover.

U.S. Pat. No. 3,981,039

Inventor: Joel D. Rumph

Issued: Sep. 21, 1976

A portable machine for washing dirt, mud and other types of foreign matter from the surface of golf balls comprising a short cylindrical container whose upper and lower interior surfaces are fitted with roughly textured resilient scrubbing pads and whose upper surface contains a water tight, sealable opening with a hinged snapfast lid providing a means whereby a golf ball may be introduced into the confines of said short cylindrical container and sealed within and whereby water, surfactants and other materials may also be introduced into the confines of the system and through which the entire inner system may be cleansed as needed. Further, said portable machine also comprising a permanently mounted, manually operated rotational means that when rotated in a clockwise direction causes a golf ball, which has been introduced into the system, to be rotated circularly around the inner dimensions of said short cylindrical container in such a manner that the upper and lower surface scrub pads in cooperation with the surfactant solution remove alien deposits, wash and thoroughly cleanse the outer surface of the rotated golf ball and whereby, on the other hand, counter-clockwise rotation of the rotational means causes upon the manual opening of the snapfast hinged lid in the upper surface a previously introduced golf ball to ride up upon the internally contained components of the rotational means and thus to be ejected from the system. Additionally, the system is so designed that allowance is made for replenishment of wash solutions as well as for the complete cleansing of the internal system by its being simply rinsed in a stream of water such as flows from a common water tap.

U.S. Pat. No. 4,163,299

Inventor: Alex J. Duda

Issued: Aug. 7, 1979

A portable golf ball washer including a cylindrical housing defining a washing chamber, the housing having an opening in a peripheral wall thereof permitting a conventional golf ball to be inserted into the washing chamber, ball scrubbing means disposed in the washing chamber, manually actuatable means rotatable in one direction about the longitudinal axis of said cylindrical housing for impelling a golf ball in a substantially circular path over the scrubbing means and simultaneously rotating the ball about various axes, the manually actuatable means being rotatable in the opposite direction about said axis for ejecting the ball through said opening, and means for releasably securing the housing to a support such as a golf cart or a golf bag.

U.S. Pat. No. 4,344,203

Inventor: Richard L. Gerrick

Issued: Aug. 17, 1982

A portable golf ball washer comprising a vertical cylindrical container closed at the bottom and open at the top and lined with a piece of stiff bristled carpet having the bristles to extend inwardly and the tips defining a core hole of less diameter than that of a golf ball to be scrubbed, a plunger having one end comprising a handle extending beyond the open end of said container when fully inserted, and the other end of said plunger having a U-shaped bail-like ball-retaining member of wire formed into a circular portion extending around a ball when contained therein for more than 180 degrees of the circumference and the legs of said member being parallel and terminating in inwardly projecting ends inserted into the sides of the other end of said plunger.

U.S. Pat. No. 5,400,455

Inventor: Norman Crossley

Issued: Mar. 28, 1995

Hand held golf ball washing apparatus having a ball receiving chamber wherein a ring-shaped rotatable brush is positioned. The brush is driven on its axis by a battery-powered motor. Push button switch means is provided to selectively operate the motor. A removable hatch is provided in the apparatus to allow insertion and removal of a golf ball to be cleaned, and for insertion of a detergent solution.

U.S. Pat. No. 5,758,379

Inventor: Vahak Stephan Hovnanian

Issued: Jun. 2, 1998

A golf ball washer and conditioner is disclosed. The golf ball washer and conditioner is portable and may be carried by the golfer on a golf cart. The golf ball washer and conditioner is constructed from insulated material so that the golf balls can be kept warm during cold weather.

While these golf ball-cleaning devices may be suitable for the purposes for which they were designed, they would not be as suitable for the purposes of the present invention, as hereinafter described.

SUMMARY OF THE PRESENT INVENTION

The present invention discloses a hand-operated golf ball cleaning device comprising a housing having bristles located therein wherein the bristle ends being configured to form a circular, semi-spherical entrainment groove into which the golf balls to be cleaned are placed for cleaning. Also shown are a hinged, securable cover with a central recess for accommodating a shaft member, a shaft member having a handle portion on the exterior distal end, a ball entrainment block on the distal end facing the housing, and a means therebetween for rotatably securing the shaft member within the shaft recess of the cover. The entrainment block has two recesses of a diameter similar to that of a golf ball and sized to receive approximately one-third of each ball therein when the cover is closed. The turning of the handle rotates the shaft and the entrainment block with the golf balls rotatably secured therein meanwhile applying sufficient pressure to the balls so they remain frictionally engaged with the bristle ends as the bristle ends dislodge dirt and debris from the dimples and rotate the balls inside the recesses of the spinning entrainment block as they travel along the entrainment groove formed by the bristle ends.

A primary object of the present invention is to provide a portable hand-operated golf ball cleaning device wherein the golf ball travels along an arcuate groove of cut bristles by means of a hand operated entrainment block in which the golf balls are rotatably partially maintained and which also provides a bias of the balls against the bristles to dislodge any dirt and debris while rotating the balls to insure that the entire surface of each ball is thoroughly scrubbed.

An additional object of the present invention is to provide a portable hand-operated golf ball cleaning device having a housing with a hinged cover that can be secured with a latch member.

Another object of the present invention is to provide a portable hand-operated golf ball cleaning device wherein the entrainment block is rotated by the user turning a handle attached to a shaft communicating between said handle and the entrainment block.

A yet further object of the present invention is to provide a portable hand-operated golf ball cleaning device having a row of bristles extend down from the inside of the cover peripheral to the entrainment block to provide further scrubbing capabilities.

Still another object of the present invention is to provide a portable hand-operated golf ball cleaning device having a pivoting handle for moving the handle from an inoperative to an operative rotational position.

One more object of the present invention is to provide a portable hand-operated golf ball cleaning device that is simple and easy to use.

A further object of the present invention is to provide a portable hand-operated golf ball-cleaning device that is economical in cost to manufacture.

Further objects of the present invention will appear as the description proceeds.

To the accomplishments of the above and related objects, this invention may be embodied in the form illustrated in the accompanying drawings, attention being called to the fact, however, that the drawings are illustrative only, and that changes may be made in the specific construction illustrated and described in the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

LIST OF REFERENCE NUMERALS

Figure 1:
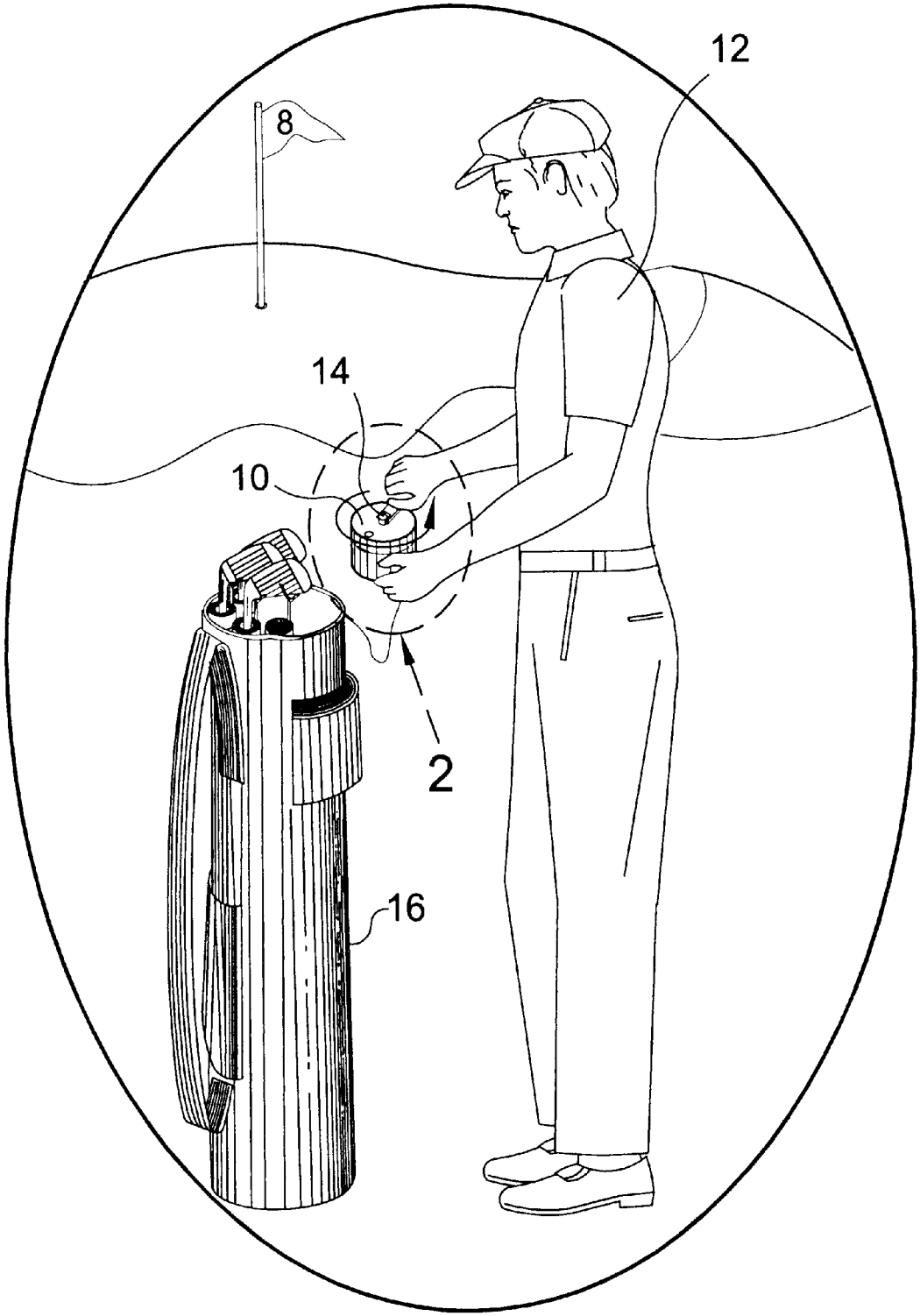
FIG. 1 is a perspective view of the present invention in use.

With regard to reference numerals used, the following numbering is used throughout the drawings.

10 present invention
12 golfer
14 handle
16 golf bag
18 golf balls
20 handle

21 pin means
22 housing
24 cover
26 hinge
28 handle lock recess
30 entrainment block
32 recess of entrainment block
34 bristles
35 groove
36 shaft
38 handle knob
40 latch mechanism
42 clip attachment ring
44 base of latch
46 post of latch
48 gasket

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments, practitioners skilled in the art will recognize numerous other embodiments as well. For definition of the complete scope of the invention, the reader is directed to the appended claims.

Turning to FIG. 1, shown therein is a perspective view of the present invention 10 in use. The present invention is being used by a golfer 12 to clean dirt, debris and any foreign matter from the dimples of golf balls to maintain the aerodynamic integrity thereof The user 12 turns the handle 14 to cause the balls to travel along the bristles as they rotate within the entrainment block recesses thereby providing a thorough frictional scrubbing action across the entire surface of each ball. The present invention 10 may be attached by means to the golf bag 16 as will be further explained hereinafter.

Figure 2:
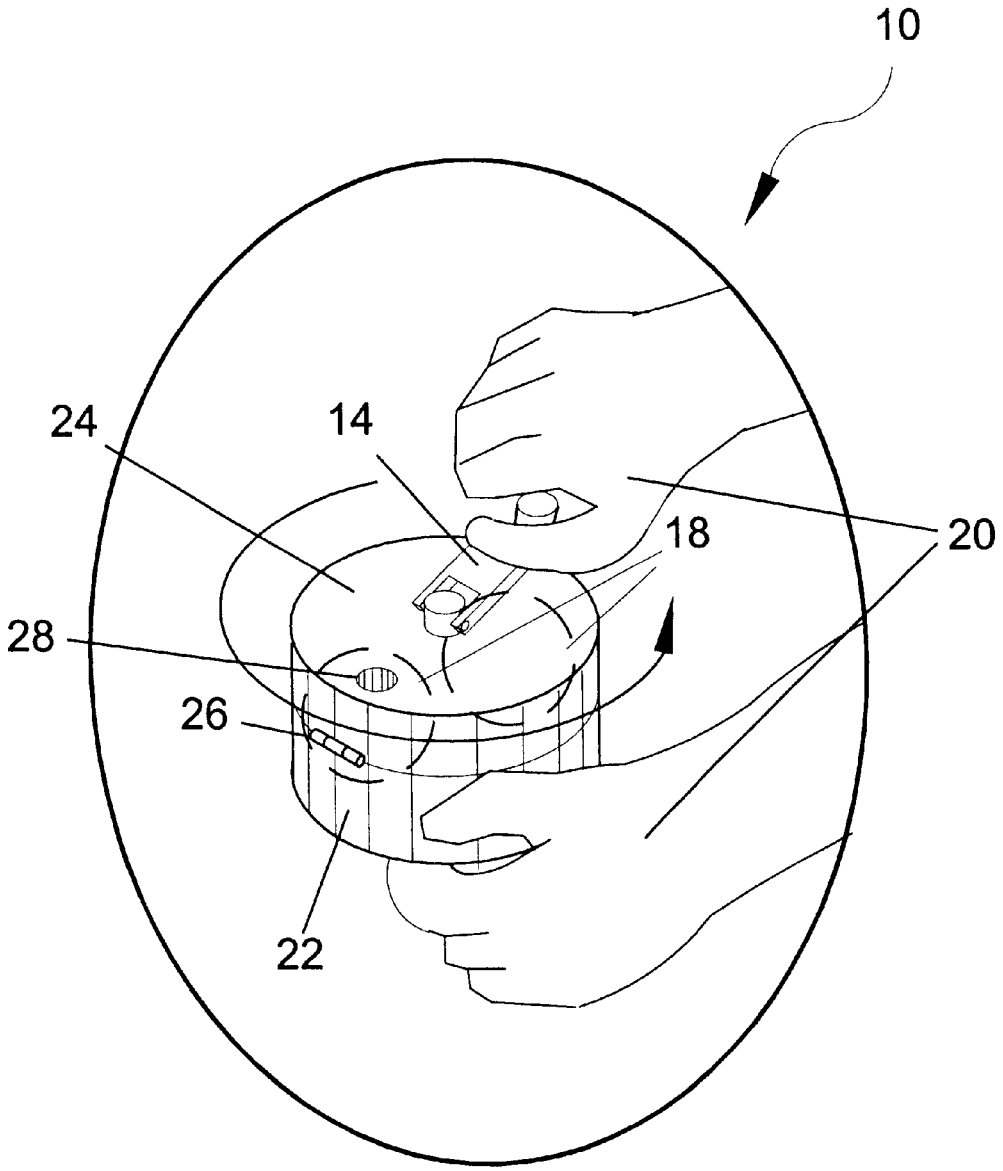
FIG. 2 is an enlarged perspective view of the present invention.

Turning to FIG. 2, shown therein is a perspective view of the present invention 10. The golf balls 18 are inside the recesses of the entrainment block that places a bias thereupon resulting in the frictional engagement of the balls against the bristles. The hands 20 of the user turn the handle 14 to cause the balls 18 to travel along the bristles as they rotate within the entrainment block recesses (not shown but see FIG. 4) thereby providing a thorough scrubbing action across the entire surface of each ball. Also shown are the housing 22 with cover 24 attached by hinge 26 along with the handle lock recess 28.

Figure 3:
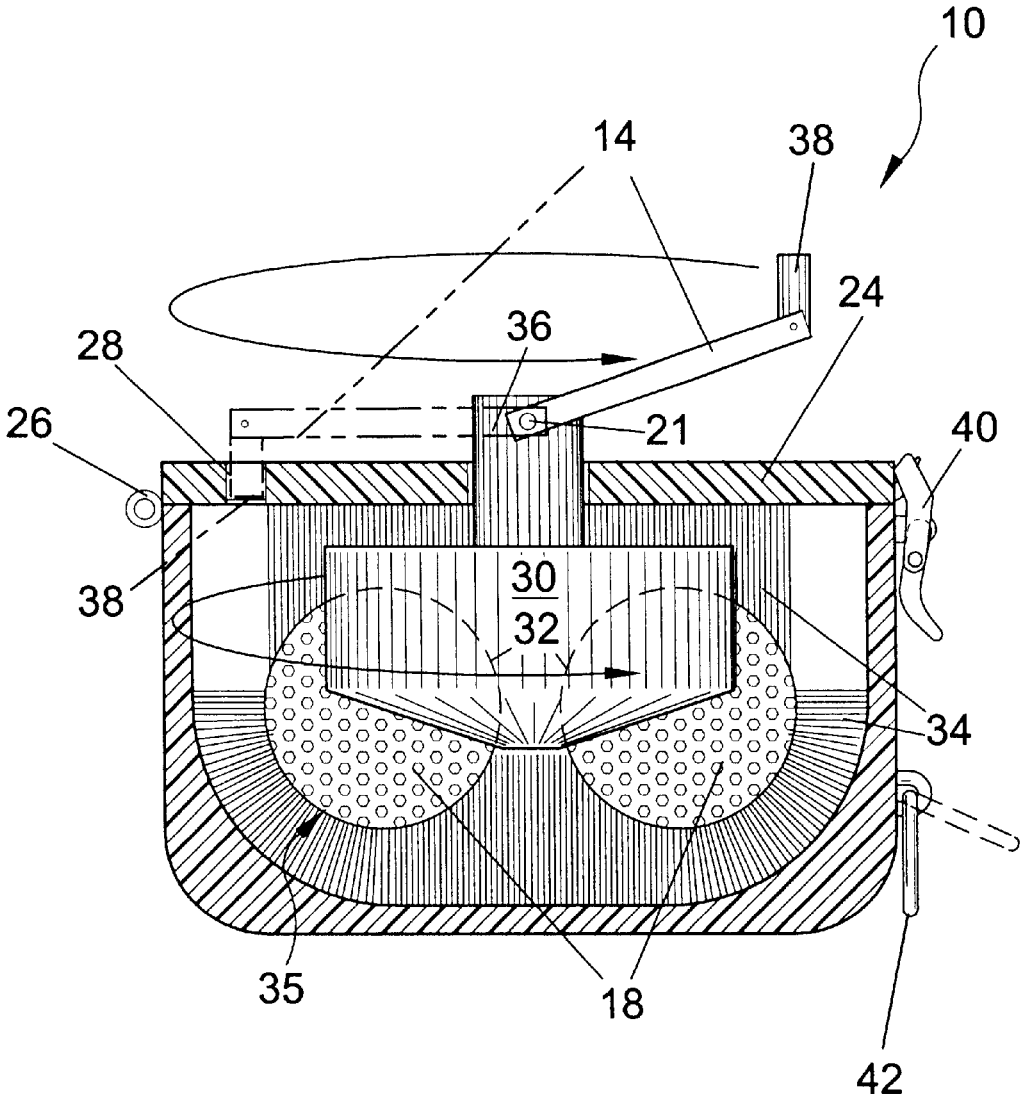
FIG. 3 is a cross sectional side view of the present invention in use.

Turning to FIG. 3, shown therein is a sectional side view of the present invention 10 in use. The golf balls 18 are disposed inside the recesses 32 of the entrainment block 30 that places a bias thereupon resulting in the frictional engagement of the balls 18 against the upper and lower bristles 34. The user turns the handle 14 to cause the balls to travel along an arcuate groove 35 best seen in the lower bristles as the balls rotate within the entrainment block recesses 32 thereby providing a thorough scrubbing action across the entire surface of each ball 18. Also shown are the shaft 36, handle knob 38, handle locking recess 28, pin means 21 for connecting the handle 14 to shaft 36, hinge 26, cover 24, latch mechanism 40 and clip attachment ring 42.

Figure 4:
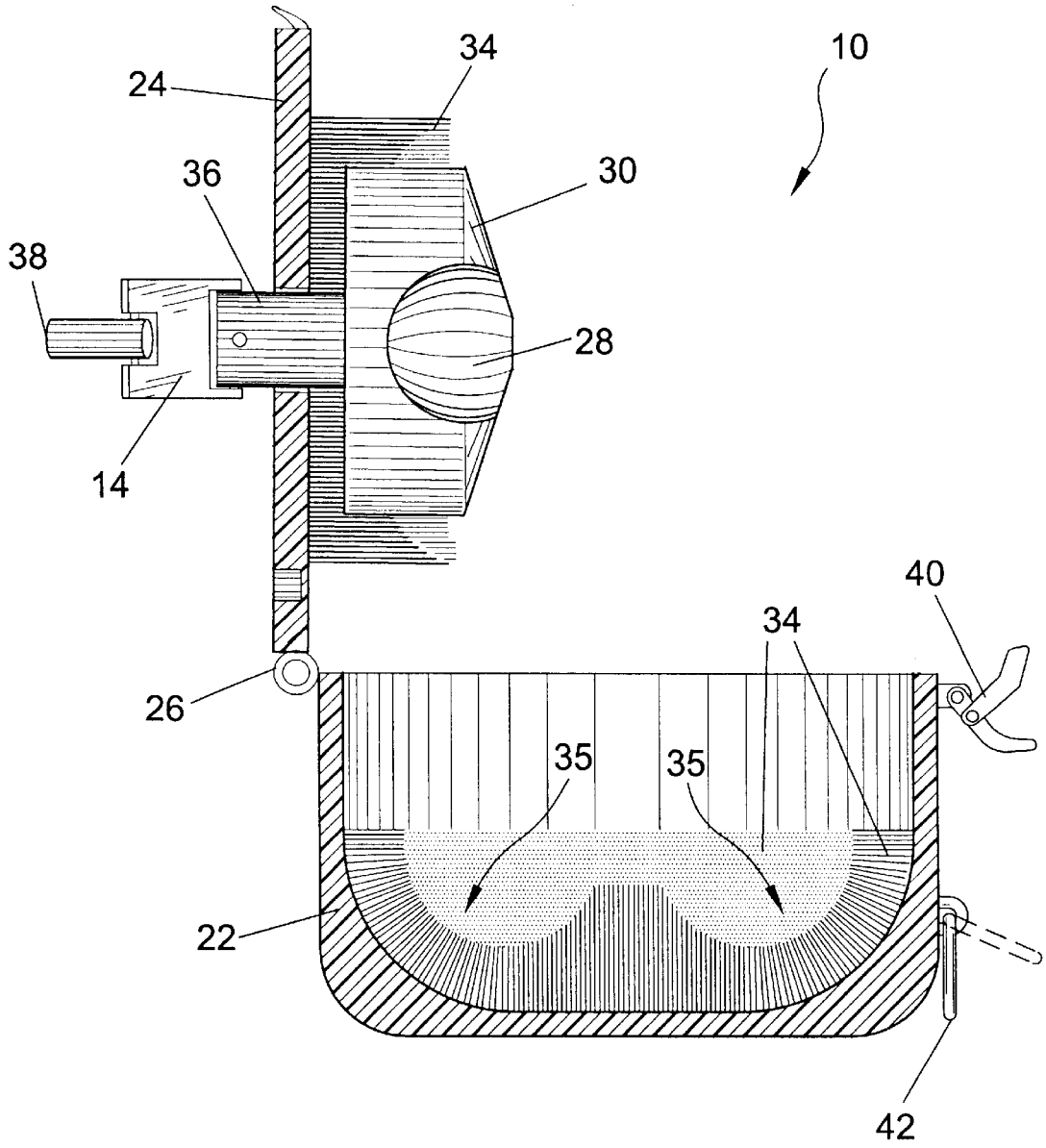
FIG. 4 is a cross sectional side view of the present invention.

Turning to FIG. 4, shown therein is a cross sectional side view of the present invention 10 wherein the latch 40 has been opened, the golf balls removed, the cover 24 opened and the handle 14 turned so the ball receiving recess 28 of the entrainment block 30 is visible. Other elements previously disclosed are also shown.

Figure 5:
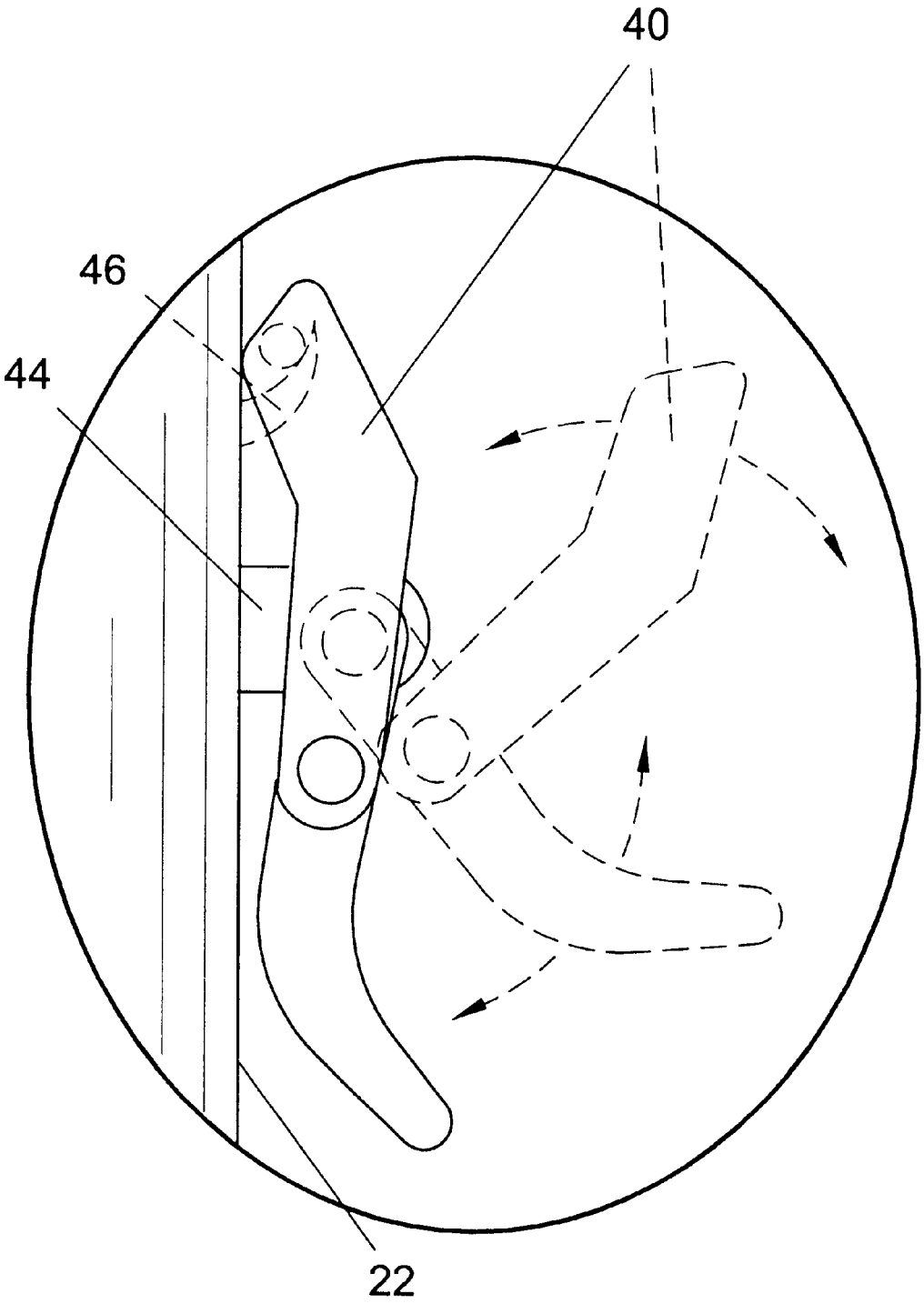
FIG. 5 is a side view of the latching mechanism.

Turning to FIG. 5, shown therein is a side view of the latching mechanism 40 wherein the double pivoting properties of the latch mechanism 40 are demonstrated in hidden line. The latch 40 has a base 44 and attaches to a hook-like post 46 on the housing 22.

Figure 6:
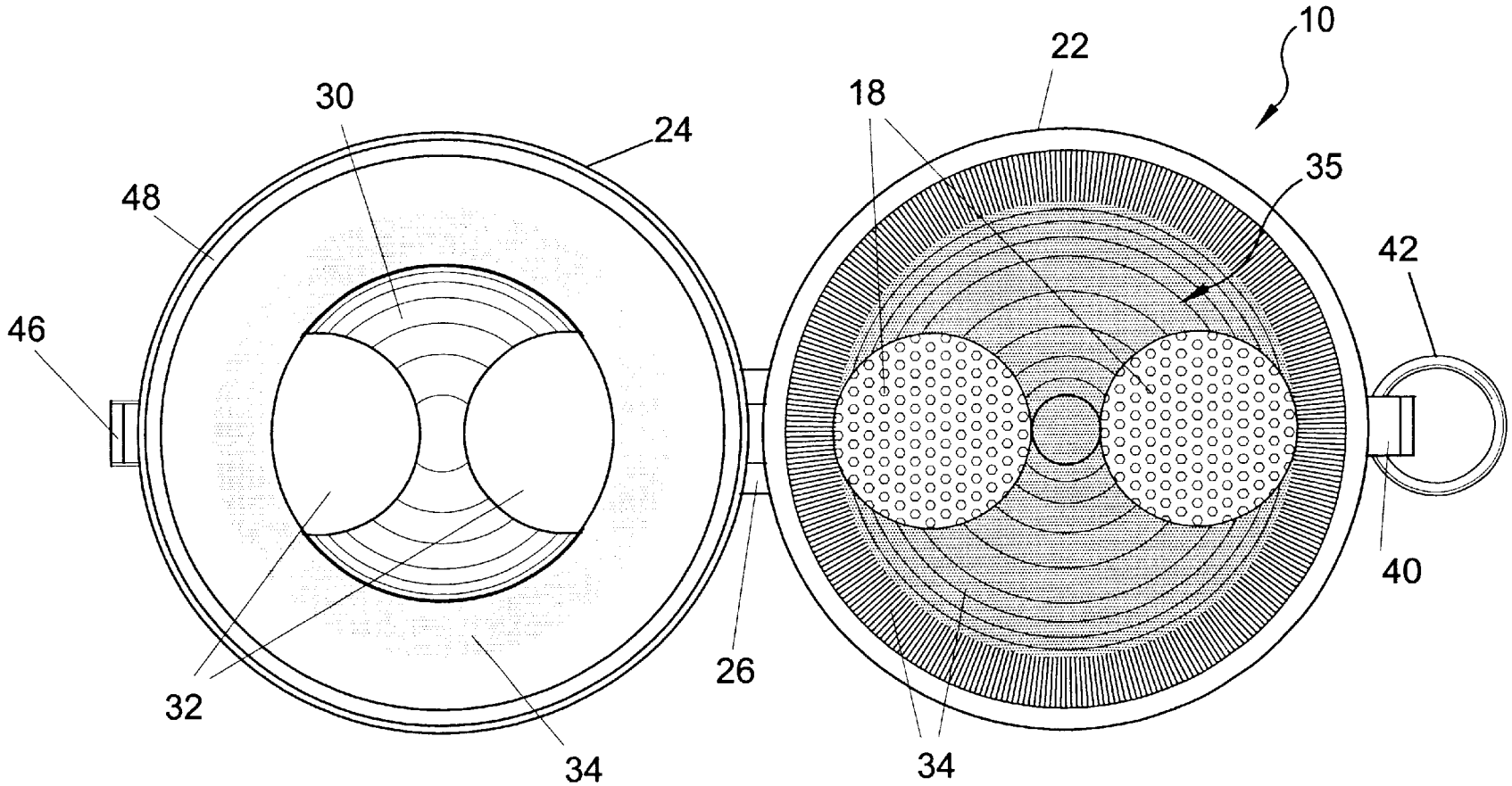
FIG. 6 is a top view of the present invention with the cover open.

Turning to FIG. 6, shown therein is a top view of the present invention 10 with the cover 24 open and the golf balls 18 resting on the entrainment track or groove 35 formed by the bristles 34 within the housing 22. The gasket 48 on the cover 24 hermetically seals the interior chamber once the latch mechanism 40 is secured. The clip attachment ring 42 disposed on a post on the side of the housing allows a user to attach different kinds of clip members to the present invention to conveniently attach it to a golf bag as needed. Other elements previously disclosed are also shown.

I claim:

1. An apparatus for cleaning golf balls, comprising:

a) a cylindrical housing, said housing having a top and a bottom, said housing sized to receive a pair of golf balls therein;

b) a cover disposed on said top of said housing wherein said cover can be secured to said housing, said cover having a centrally disposed aperture therein and a recess offset from the center therein;

c) means for a rotatable entrainment block disposed internal said housing whereby a pair of golf balls are retained therein and the entrainment block manually rotated by a user; and, d) means for a plurality of bristles disposed internal said housing whereby the golf balls are cleaned as the golf balls rotate internal the housing.

2. The apparatus of claim 1, wherein said cover further comprises a hinge for hingedly connecting said cover to the housing.

3. The apparatus of claim 2, wherein said cover further comprises means for a latch whereby the cover can be secured to the housing.

4. The apparatus of claim 3, wherein said means for a latch further comprises a latch, a latch base upon which said latch moves, said latch base being disposed on said housing, and a post disposed on said cover to which said latch attaches.

5. The apparatus of claim 4, wherein said means for a rotatable entrainment block further comprises:

a) an entrainment block, wherein said block is shaped like a circular disk, said disk having a pair of oppositely disposed recesses therein, wherein said recesses are sized to receive about one-third a golf ball therein, said disk having a top and a bottom, wherein said recesses are disposed on opposite edges of said bottom of said disks;

b) a shaft centrally disposed on said top of said disk, c) wherein said shaft passes through said aperture of said cover; and, d) wherein said shaft has a distal end for receiving a handle thereon.

6. The apparatus of claim 5, further comprising a handle disposed on said distal end of said shaft of said entrainment block.

7. The apparatus of claim 6, wherein said handle further comprises a pin means for connection to said distal end of said shaft, said handle being pivotable upon said pin means between the vertical plane and the horizontal plane.

8. The apparatus of claim 7, wherein said handle further comprises a pivotable knob for being grasped by a user.

9. The apparatus of claim 8, wherein said recess of said cover is sized to receive said knob of said handle when said handle is pivoted into the horizontal plane position.

10. The apparatus of claim 9, wherein said means for a plurality of bristles further comprises:

a) a first plurality of downwardly extending bristles disposed on said cover for cleaning the golf balls;

b) wherein said downwardly extending bristles surround said entrainment block and the golf balls retained therein;

c) a second plurality of bristles disposed internal said housing for cleaning the golf balls;

d) wherein said second bristles are sized to surround and contact the golf balls disposed in said recess of said entrainment block; and, e) a circular groove being disposed in said second bristles wherein the golf balls travel and are cleaned thereby.

11. The apparatus of claim 10, wherein said second bristles generally point toward the center of each of the golf balls held within said recesses of said entrainment block.

12. The apparatus of claim 11, wherein said cover further comprises a gasket disposed about its periphery, said gasket disposed between said cover and said housing for sealing the contents of said housing.

13. The apparatus of claim 12, further comprising means for attachment of said housing to a golf bag.

14. The apparatus of claim 13, wherein said means for attachment further comprises a ring, said ring being disposed on a post, said post being disposed on said housing.

* * * * *